US005540006A

United States Patent [19]

Lloyd

[11] Patent Number: 5,540,006

[45] Date of Patent: Jul. 30, 1996

[54] PICKUP TRUCK-MOUNTED HYDRAULIC TOOL CARRIER

[76] Inventor: Claud A. Lloyd, 2306 Dexter, Terre Haute, Ind. 47805

[21] Appl. No.: 338,958

[22] Filed: Nov. 14, 1994

[51] Int. Cl.[6] ..... E02F 5/00

[52] U.S. Cl. ..... 37/443; 37/403; 414/912

[58] Field of Search ..... 37/403, 404, 405, 37/943; 414/685, 690, 694, 912; 172/810, 278, 279; 280/423, 402

[56] References Cited

U.S. PATENT DOCUMENTS

| | | | |
|---|---|---|---|
| 4,463,858 | 8/1984 | Bilas | 280/402 |
| 4,761,016 | 8/1988 | Groud | 172/279 X |
| 4,869,002 | 9/1989 | Glenn | 37/403 |
| 4,925,358 | 5/1990 | Cook | 414/685 |

*Primary Examiner*—Terry Lee Melius
*Assistant Examiner*—Robert Pezzuto
*Attorney, Agent, or Firm*—H. John Barnett

[57] ABSTRACT

A portable hydraulic boom tool carrier adapted to be removably mounted on the bed of a pickup truck. The hydraulic boom tool carrier includes a self-contained hydraulic system mounted on the frame of the tool carrier. It also includes a pair of outrigger legs which can be extended below the tool carrier to the ground to provide support for the unit during worksite operations. The tool carrier can be easily mounted or removed from the flat bed of a pickup truck.

8 Claims, 2 Drawing Sheets

PICKUP TRUCK-MOUNTED HYDRAULIC TOOL CARRIER

BACKGROUND

1. Field of the Invention

This invention relates to hydraulic boom tool carriers, and, more particularly, to a tool carrier which is removably mounted on the bed of a pickup truck. There are many applications where a hydraulic boom tool carrier is needed for jobs where more expensive, specialized equipment is not economically feasible. One particularly useful tool is a digger for excavating.

2. Description of the Related Art

There are many patents related to portable digging equipment, including the following:

| Pat. No. | Inventor | Date |
|---|---|---|
| 3,445,946 | Striggow | 1969 |
| 3,483,640 | Anderson, et al | 1969 |
| 4,251,181 | Drott, et al | 1981 |
| 4,987,689 | Kaczmarski, et al | 1991 |
| 5,058,685 | Moffitt | 1991. |

None of the above patents show a digger which is mountable of the bed of a pickup truck.

Striggow describes an earth handling vehicle which includes a hitch for a tractor. Striggow appears to have four wheels, and is adapted to be pulled by a tractor. This earth handling vehicle would remain in contact with the ground during transport.

Anderson, et al shows apparatus for stabilizing an earth-moving scraper. An auxiliary bowl having cam track surfaces supports rollers on a self-loading elevator during unloading.

Drott, et al shows an implement coupling apparatus for a boom-type vehicle. FIG. 1 of this patent shows a special vehicle for transporting the digging equipment. Kaczmarski, et al show an attachment means for attaching a trencher to a special power unit. There are three or more mounts on an end of the power unit so that it is possible to trench beside a structure.

Moffitt describes a dozer blade mounting apparatus for mounting a dozer blade on the frame of an implement. The mounting apparatus enables extended angling and vertical movement of the blade while minimizing the distance between the dozer blade and the frame of the implement.

SUMMARY OF THE INVENTION

This invention is directed to a hydraulic boom tool carrier which is removably mounted on the bed of a conventional pickup truck. The tool carrier is totally supported and carried by the pickup truck when being moved between worksites. This tool carrier includes retractable support legs and a counterweight boom which is mounted on the bed of the pickup truck by means of a quick release hold-down clamp.

The underframe of the tool carrier is firmly attached to the rear end of the truck bed frame by means of a trailer hitch assembly. The tool carrier is easily removed from the truck bed when not needed, so the pickup truck can be used for hauling and other purposes.

This new combination of an hydraulic boom tool carrier which is removably mounted on the back of an ordinary pickup truck greatly decreases the initial cost of a smaller size, hydraulic boom tool carrier because most operators already have a pickup truck for other purposes. The pickup truck provides a multi-purpose vehicle for an hydraulic boom tool carrier which is otherwise usually provided with its own "dedicated" vehicle.

Usually, such single purpose excavating vehicles must be transported to the job site on a trailer, or on a larger truck, because the drive system is not designed for ordinary highway travel. In the detailed description set forth below, the tool is a digging tool.

DESCRIPTION OF THE PREFERRED EMBODIMENT

Figure 1:
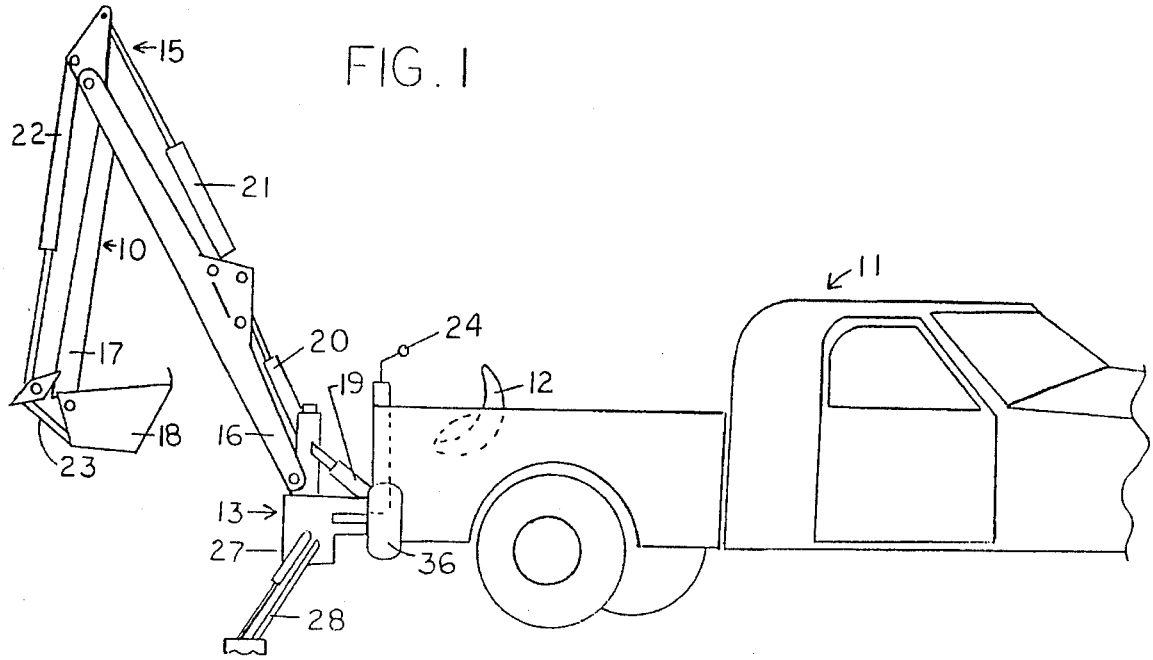
FIG. 1 of the drawings is a general perspective view of the excavating unit assembled on the bed of a pickup truck.

As shown in the drawings, an excavating unit 10 is removably mounted on a pickup truck 11. Operator seat 12 is supported on a frame 13 which rests on truck bed 14. The frame 13 extends rearwardly out of the truck bed 14, and supports an hydraulic boom 15 which has a inner arm 16, an outer arm 17 and a digging tool 18.

Figure 4:
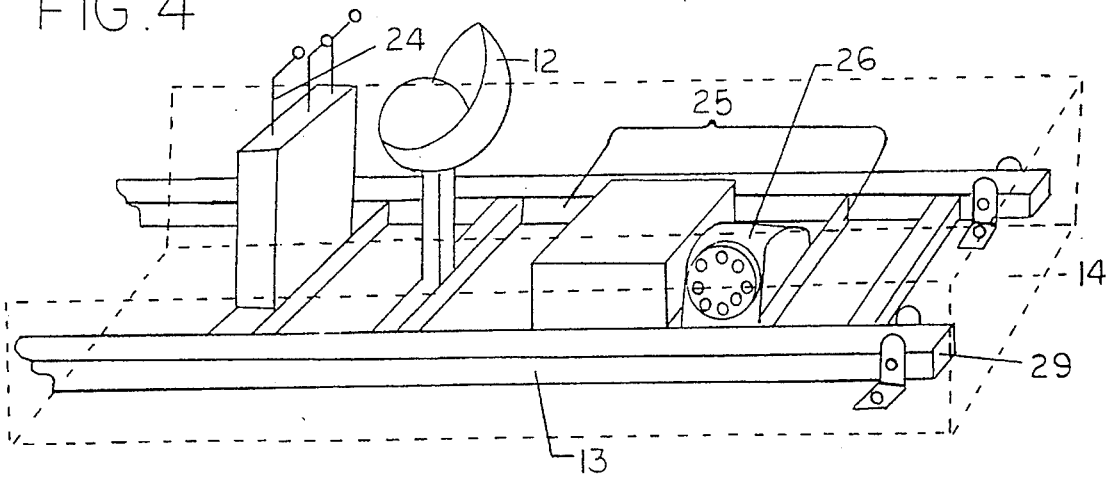
FIG. 4 is a schematic perspective view, with some parts broken away, showing the operating and hydraulic drive assemblies of the excavating unit.

The arms 16 and 17 and the digging tool 18 are operated by means of hydraulic assemblies 19–23 from the operator seat by means of control levers 24. The excavating unit 10 is hydraulically powered by a self-contained hydraulic motor assembly 25 which includes an electric start, 16 HP twin cylinder industrial engine 26, best seen in FIG. 4.

Referring again to FIG. 1, rear end 27 of frame 13 is supported by a pair of retractable outrigger legs 28 during use of the excavating unit 10. Legs 28 are adjustable so that they provide additional stabilizing support for the excavating unit 10 during digging operations, to thereby avoid excessive loads on the suspension system of the pickup truck 11.

Figure 2:
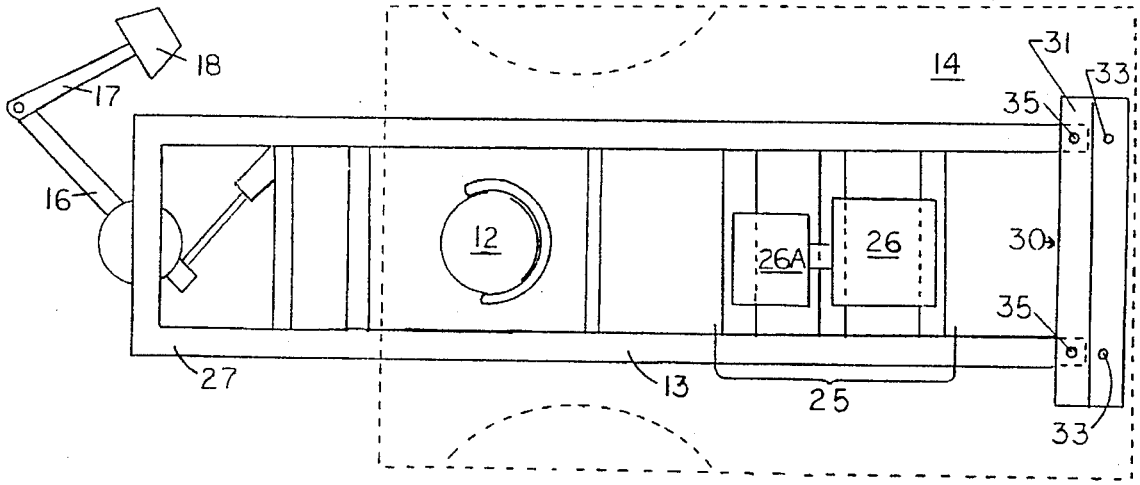
FIG. 2 is a schematic plan view of the excavating unit shown in FIG. 1, with some parts shown in phantom.
Figure 3:
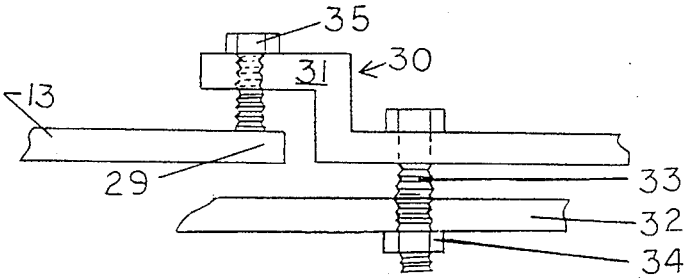
FIG. 3 is an enlarged detailed side sectional view, with some parts broken away, showing the quick release hold-down clamp for the front of the excavating unit frame.

The excavating unit 10 is removably attached to the pickup truck 11 at front end 29 of the frame 13. The front end 29 slides under, and is held in place by, a quick-release hold down clamp assembly 30, best seen in FIGS. 2 and 3.

The hold-down clamp assembly 30 includes clamp 31, which is secured directly to truck frame 32 by means of a pair of bolts 33 and nuts 34. Tightening bolts 35 disposed on the stepped clamp 31 tightens down on the front end 29 of the frame 13 to firmly secure the excavating unit 10 to the truck bed 14.

Figure 5:
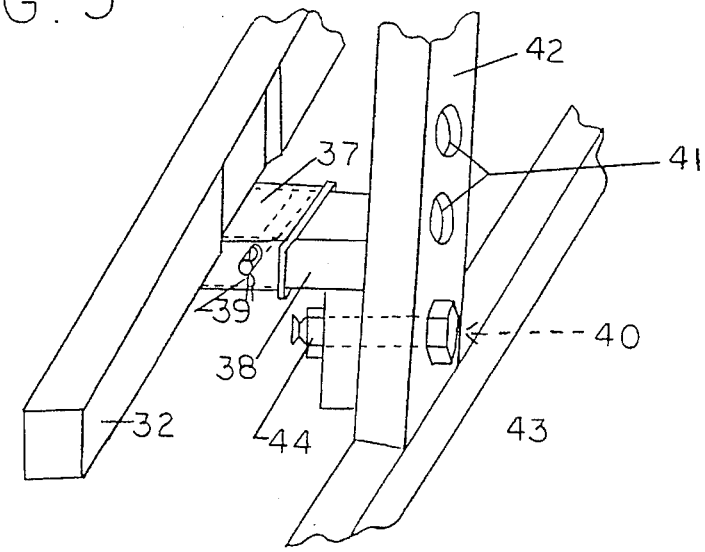
FIG. 5 is an enlarged schematic perspective view, with parts broken away, showing the attachment of the excavating unit at the rear of the pickup truck bed.

The outer, rear end 27 of the frame 13 is removably secured to the back end 36 of the truck frame 32, as best seen in FIGS. 1 and 5. As seen in FIG. 5, a trailer hitch tubular beam 37 extends rearwardly out from the back end 36 of the truck frame 32. A tubular extension bracket 38 extends forwardly into the tubular beam 37, and is secured by means of a removable pin 39.

Height adjustment for frame 13 is accomplished by positioning bolt assembly 40 in one of a plurality of vertically spaced bolt openings 41 in vertical member 42 of the frame 13. The height adjusting bolt 43 passes through one of the bolt openings 41, and through the tubular extension bracket 38 to secure the frame 13 to the tubular beam 37 by means of a nut 44 tightened onto the height adjusting bolt 43.

The hold-down clamp assembly 30 and the tubular beam 37 releasably secure the excavating unit 10 to the pickup truck 11. The outrigger legs 28 may be retracted during transport of the excavating unit 10 to and from a worksite and a storage place. The excavating unit 10 may be easily removed from the pickup truck 11 when desired. Storage support means for the front end 29 of the frame 13 can be provided at the storage location with the rear end 27 supported on the outrigger legs 28 so that a single operator can attach and release the excavating unit 10 to the pickup truck 11.

Of course, other tools can be readily mounted on the hydraulic boom 15, instead of the digging tool 18. For example, with conventional modifications, a "cherry picker" with necessary hydraulic controls in the "cherry picker" basket can replace the digging tool 18. A spray painting arm for painting large structures, such as warehouses and barns can also be conveniently mounted on the outer end of the boom 15.

As mentioned above, great economy can be realized by means of the removable, truck-mounted excavating unit of the invention. Instead of having a slow-moving vehicle dedicated for use only with the excavating unit, the excavating unit is removably mounted on the bed of a pickup truck. The excavating unit thereby utilizes the high speed mobility of the pickup truck when being transported from place to place, and the weight of the pickup truck provides a stable platform for the excavating unit when it is in use at the worksite. When the excavating unit is not needed it can be separated from the pickup truck for storage, and the pickup truck is available for other uses.

This invention provides a stable, quick-release connecting means between the excavating unit and the pickup truck, so that even a single operator can mount and dismount the excavating unit on the pickup truck. The excavating unit has a hydraulic drive system which is completely independent of the pickup truck drive, so very little modification to the pickup truck is required to adapt it to receive the excavating unit.

What is claimed is:

1. A stable, self-contained, quickly removable, portable hydraulic boom tool carrier adapted for mounting on a pickup truck bed having a front end and a rear end, said hydraulic boom tool carrier comprising:

a frame having a front end and a rear end, said frame extending rearwardly from the front end of the truck bed, and out the rear end thereof, and being adapted to rest on the bed of the pickup truck;

a hold-down clamp assembly adapted to be connected to the pickup truck at the front end of the bed to releasably secure the front end of the frame to the pickup truck;

a plurality of retractable outrigger legs connected to the rear end of said frame and adapted to be raised while the pickup truck is carrying the hydraulic boom tool carrier to or from a worksite, and adapted to be lowered to contact the ground and partially support the hydraulic boom tool carrier during working operations;

an integral, self-contained hydraulic system carried on, and supported solely by, the hydraulic boom tool carrier; and an extension bracket disposed at the rear end of the frame adapted to be releasably connected to the rear end of the pickup truck, whereby the hydraulic boom tool carrier can be securely mounted and supported on the pickup truck, and operated at a worksite.

2. The hydraulic boom tool carrier of claim 1, including:

a boom having an outer end; and a tool disposed on the outer end of the boom.

3. The hydraulic boom tool carrier of claim 2, in which the boom has an inner arm and an outer arm, and including a plurality of separate hydraulic drive assemblies for moving the inner and outer arms and the tool separately or together.

4. The hydraulic boom tool carrier of claim 3, including a hydraulic motor assembly mounted on the frame of the hydraulic boom tool carrier to drive each of the separate hydraulic drive assemblies to thereby operate the tool at the worksite.

5. The hydraulic tool carrier of claim 4, including a gasoline powered engine for driving the separate hydraulic drive assemblies to move the inner and outer arms and the tool of the boom.

6. The hydraulic boom tool carrier of claim 5, in which the tool is a digging tool.

7. The hydraulic boom tool carrier of claim 5, in which the tool is a large basket for supporting and positioning a human operator adjacent a worksite, and including hydraulic controls disposed in the basket, whereby the basket can be moved by the human operator.

8. The hydraulic boom tool carrier of claim 5, in which the tool is a spray painting arm, and including control means for the hydraulic boom and the spray painting arm disposed on the frame, whereby the spray painting arm can be controlled remotely by a human operator on the frame of the carrier when mounted on the bed of a pickup truck.

* * * * *